US008042912B2

(12) United States Patent
Guan et al.

(10) Patent No.: US 8,042,912 B2
(45) **Date of Patent: *Oct. 25, 2011**

(54) HEATER STACK HAVING RESISTIVE LAYER WITH UNDERLYING INSULATIVE GAP AND METHOD FOR MAKING HEATER STACK

(75) Inventors: Yimin Guan, Lexington, KY (US); Burton Lee Joyner, II, Lexington, KY (US); Zachary Justin Reitmeier, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 218 days.

This patent is subject to a terminal disclaimer.

(21) Appl. No.: 12/345,091

(22) Filed: Dec. 29, 2008

(65) Prior Publication Data

US 2010/0165052 A1 Jul. 1, 2010

(51) Int. Cl.
*B41J 2/05* (2006.01)

(52) U.S. Cl. ..... 347/62; 347/54; 347/55; 347/56; 347/60; 347/61; 347/63; 347/64; 347/65

(58) Field of Classification Search ..... 347/56, 347/60–65

See application file for complete search history.

(56) References Cited

U.S. PATENT DOCUMENTS

| | | | | |
|---|---|---|---|---|
| 6,457,815 | B1 * | 10/2002 | Miller et al. | 347/63 |
| 6,464,343 | B1 * | 10/2002 | Coventry et al. | 347/63 |
| 6,485,132 | B1 * | 11/2002 | Hiroki et al. | 347/65 |
| 7,195,343 | B2 * | 3/2007 | Anderson et al. | 347/63 |
| 7,841,702 | B2 * | 11/2010 | Guan et al. | 347/56 |
| 2010/0165055 | A1 * | 7/2010 | Reitmeier | 347/63 |

* cited by examiner

*Primary Examiner* — Ryan Lepisto
*Assistant Examiner* — Guy Anderson

(57) ABSTRACT

A heater stack includes first strata configured to support and form a fluid heater element responsive to energy from repetitive electrical activation and deactivation to fire repetitive cycles of heating and ejecting fluid from an ejection chamber above the fluid heater element and second strata overlying the first strata and contiguous with the ejection chamber to provide protection of the fluid heater element. The first strata includes a substrate and a heater substrata overlying the substrate and including a resistive layer having lateral portions spaced apart, a central portion extending between the lateral portions and defining the fluid heater element, and transitional portions interconnecting the central portion and lateral portions and elevating the central portion relative to the lateral portions and above the substrate to form a gap between the lateral portions and between the central portion and substrate insulating the substrate from the fluid heater element.

9 Claims, 2 Drawing Sheets

HEATER STACK HAVING RESISTIVE LAYER WITH UNDERLYING INSULATIVE GAP AND METHOD FOR MAKING HEATER STACK

BACKGROUND

1. Field of the Invention

The present invention relates generally to micro-fluid ejection devices and, more particularly, to a heater stack having a resistive layer with an underlying insulative gap and a method for forming the heater stack.

2. Description of the Related Art

Micro-fluid ejection devices have had many uses for a number of years. A common use is in a thermal inkjet printhead in the form of a heater chip. In addition to the heater chip, the inkjet printhead basically includes a source of supply of ink, a nozzle plate attached to or integrated with the heater chip, and an input/output connector, such as a tape automated bond (TAB) circuit, for electrically connecting the heater chip to a printer during use. The heater chip is made up of a plurality of resistive heater elements, each being part of a heater stack. The term "heater stack" generally refers to the structure associated with a portion of the thickness of the heater chip that includes first, or heater forming, strata made up of resistive and conductive materials in the form of layers or films on a substrate of silicon or the like and second, or protective, strata made up of passivation and cavitation materials in the form of layers or films on the first strata, all fabricated by well-known processes of deposition, patterning and etching upon the substrate of silicon. The heater stack also has one or more fluid vias or slots that are cut or etched through the thickness of the silicon substrate and the first and second strata, using these well-known processes, and serve to fluidly connect the supply of ink to the heater stacks. A heater stack having this general construction is disclosed as prior art in U.S. Pat. No. 7,195,343, which patent is assigned to the same assignee as the present invention. The entire disclosure of this patent is hereby incorporated herein by reference.

Despite their seeming simplicity, construction of heater stacks requires consideration of many interrelated factors for proper functioning. The current trend for inkjet printing technology (and micro-fluid ejection devices generally) is toward lower jetting energy, greater ejection frequency, and in the case of printing, higher print speeds. A minimum quantity of thermal energy must be present on an external surface of the heater stack, above a resistive heater element therein, in order to vaporize the ink inside an ink chamber between the heater stack external surface and a nozzle in the nozzle plate so that the ink will vaporize and escape or jet through the nozzle in a well-known manner.

During inkjet heater chip operation, some of the heating energy is wasted due to heating up the "heater overcoat", or the second strata, and also heating up the substrate. Since heating or jetting energy required is proportional to the volume of material of the heater stack that is heated during an ejection sequence, reducing the heater overcoat thickness, as proposed in U.S. Pat. No. 7,195,343 is one approach to reducing the jetting energy required. However, as the overcoat thickness is reduced, corrosion of the ejectors or heater elements becomes more of a factor with regard to ejection performance and quality. So this patent proposes the additional steps of applying a sacrificial layer of an oxidizable metal on the resistive heater layer and then oxidizing the sacrificial layer to convert it to exhibit a protective function rather than a conductive function and thereby obviate the potential corrosive impacts of reducing overcoat thickness.

However, with the overcoat thickness decreasing, heat loss to the substrate then becomes the dominant factor. Thus, there is a need for an innovation that will reduce the heat loss to the substrate.

SUMMARY OF THE INVENTION

In an aspect of the present invention, a heater stack for a micro-fluid ejection device includes first strata configured to support and form a fluid heater element responsive to energy from repetitive electrical activation and deactivation to fire repetitive cycles of heating and ejecting of a fluid from an ejection chamber above the fluid heater element. The first strata include a substrate and heater substrata overlying the substrate. The heater substrata includes a resistive layer having lateral portions spaced apart from each other, a central portion extending generally between the lateral portions and defining the fluid heater element of the first strata, and transitional portions respectively interconnecting the central portion and lateral portions and extending upwardly from the lateral portions so as to elevate the central portion relative to the lateral portions and spaced above the substrate to form a gap extending between the lateral portions and between the central portion and the substrate substantially insulating the substrate from the fluid heater element so as to reduce heat transfer from the fluid heater element to the substrate and thereby increase heat transfer into the fluid in the ejection chamber from firing the repetitive cycles of heating and ejecting of the fluid from the ejection chamber above the fluid heater element. The gap is normally closed along opposite sides of the central portion of the resistive layer to block communication of flow of fluid between the ejection chamber above the fluid heater element and the gap below the fluid heater element such that the gap is filled with insulative gas reducing transfer of heat to the substrate. Alternatively, the gap may be provided open to allow communication of fluid flow between the ejection chamber and gap. The heater stack also includes second strata overlying the first strata and contiguous with the ejection chamber to provide protection of the fluid heater element from adverse effects of the repetitive cycles of fluid ejection and of the fluid in the ejection chamber.

In another aspect of the present invention, a method for making a heater stack includes depositing and patterning a sacrificial material on a substrate to provide a layer of the sacrificial material having a predetermined size and thickness corresponding to a desired gap in the heater stack, processing one sequence of materials to produce first strata having a heater substrata overlying the substrate and the layer of sacrificial material such that a fluid heater element in the heater substrata overlies the layer of sacrificial material, and decomposing the layer of sacrificial material to leave the gap above the substrate, substantially emptied of sacrificial material, and below the fluid heater element for insulating the substrate from transfer of heat energy produced by the fluid heater element to fire repetitive cycles of ejection of the fluid from an ejection chamber above the fluid heater element. The gap may be open or closed along opposite sides of the heater element. The processing one sequence of materials includes depositing and patterning a resistive layer over the substrate and layer of sacrificial to provide lateral portions of the resistive layer on the substrate spaced apart from each other, a central portion of the resistive layer on the layer of sacrificial material extending generally between the lateral portions, and transitional portions respectively interconnecting the central portion and lateral portions and extending upwardly from the lateral portions to the central portion elevated by the layer of sacrificial material relative to the lateral portions and substrate. The processing one sequence of materials also includes depositing and patterning a conductive layer over the resistive layer to provide separate anode and cathode portions overlying and deposited at least on the lateral portions of the resistive layer such that the anode and cathode portions are interconnected and separated by the central portion of the resistive layer to define the fluid heater element therewith overlying the layer of sacrificial material. The method further includes processing another sequence of materials to produce second strata overlying the first strata and contiguous with the ejection chamber to provide protection of the fluid heater element from adverse effects of the repetitive cycles of fluid ejection and of the fluid in the ejection chamber.

BRIEF DESCRIPTION OF THE DRAWINGS

Figure 1:
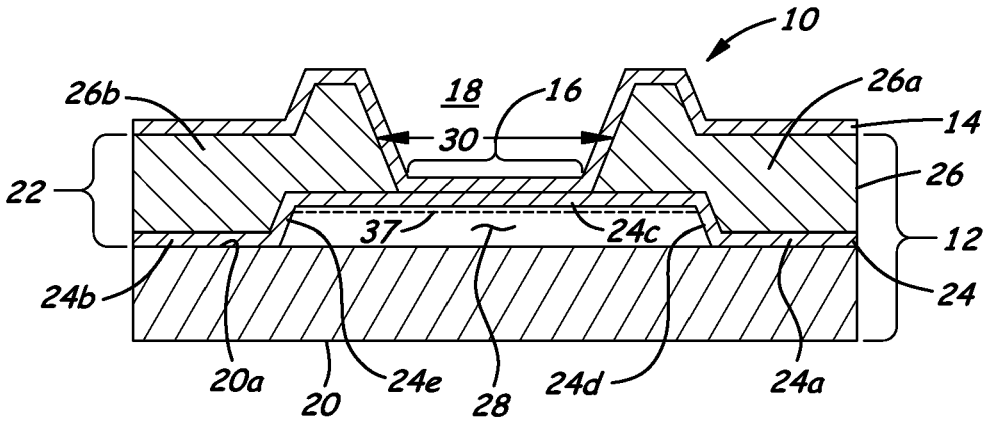

Having thus described the invention in general terms, reference will now be made to the accompanying drawings, which are not necessarily drawn to scale and in some instances portions may be exaggerated in order to emphasize features of the invention, and wherein:

FIG. 1 is a cross-sectional schematic representation, not to scale, of an exemplary embodiment of a heater stack of a micro-fluid ejection device in accordance with the present invention.

Figure 2:
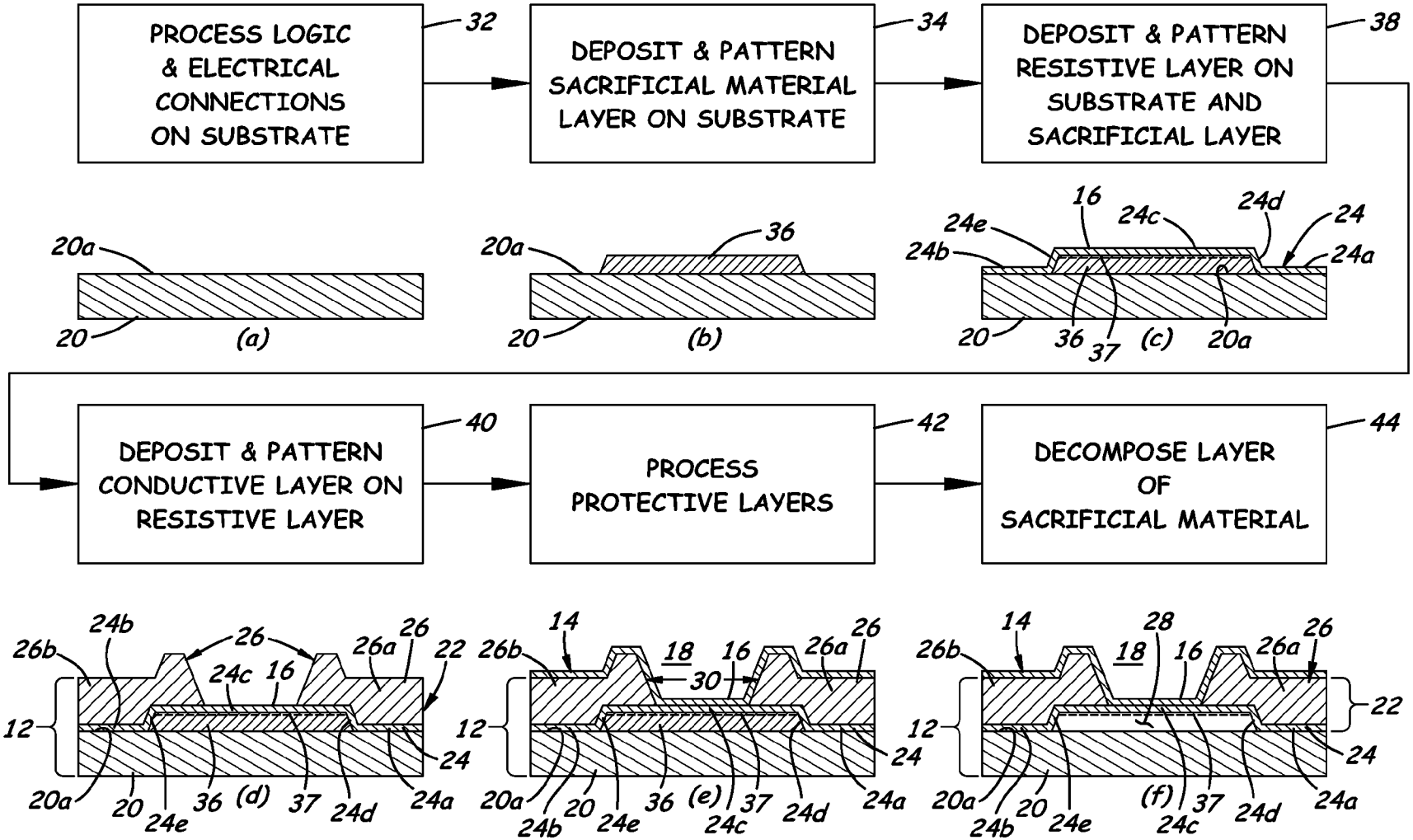

FIG. 2 is a flow diagram with accompanying schematic representations, not to scale, of an exemplary sequence of stages in a method for making the heater stack of FIG. 1 in accordance with the present invention.

Figure 3:
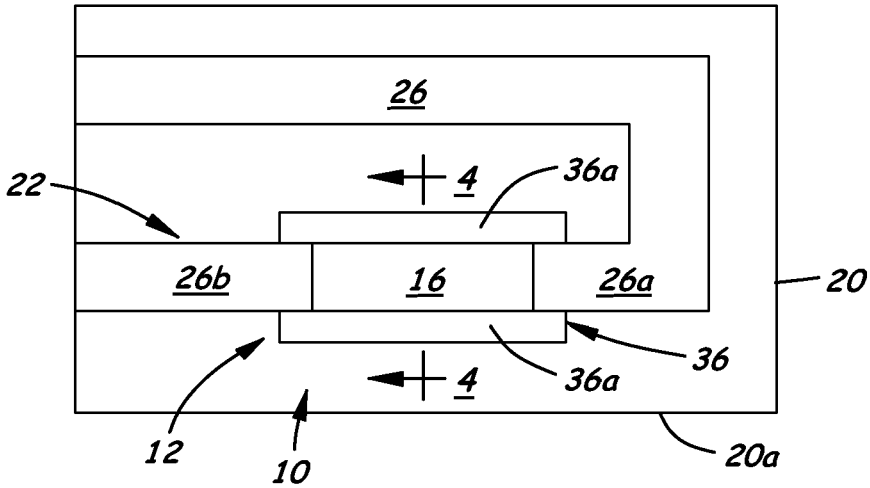

FIG. 3 is a plan schematic representation, not to scale, of an exemplary embodiment of the heater stack slightly modified in accordance with the present invention by the layer of sacrificial material extending beyond the opposite sides of the heater substrata of the heater stack.

Figure 4:
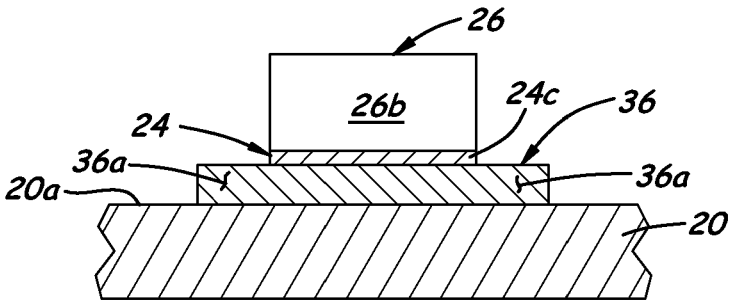

FIG. 4 is an enlarged cross-sectional view taken along line 4-4 of FIG. 3, showing the layer of sacrificial material extending beyond the opposite sides of the heater substrata of the heater stack.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Also, the present invention applies to any micro-fluid ejection device, not just to heater stacks for thermal inkjet printheads. While the embodiments of the present invention will be described in terms of a thermal inkjet printhead, one of ordinary skill will recognize that the invention can be applied to any micro-fluid ejection system.

Referring now to FIG. 1, there is illustrated an exemplary embodiment of a heater stack, generally designated 10, of a micro-fluid ejection device in accordance with the present invention. The heater stack 10 basically includes first (or heater forming) strata, generally designated 12, and second (or protective) strata, generally designated 14. The first strata 12 are configured to support and form a fluid heater element 16 in the heater stack 10 that is responsive to repetitive electrical activation and deactivation to produce repetitive cycles of fluid ejection from the ejection device. The second strata 14 overlie the first strata 12, are contiguous with a fluid ejection chamber 18 above the second strata 14, and are configured to protect the heater element 16 from well-known adverse effects of the repetitive cycles of fluid ejection from the ejection chamber 18.

More particularly, the first strata 12 of the heater stack 10 include a substrate 20 and heater substrata, generally designated 22, overlying a front surface 20*a* of the substrate 20. The heater substrata 22 include an electrical resistive film or layer 24 and an electrical conductor film or layer 26. The resistive layer 24 has right and left lateral portions 24*a*, 24*b* spaced apart from each other, a central portion 24*c* extending generally between the lateral portions 24*a*, 24*b* and defining the fluid heater element 16 in the heater substrata 22, and right and left transitional portions 24*d*, 24*e* interconnecting the central portion 24*c* with the right and left lateral portions 24*a*, 24*b*. The transitional portions 24*d*, 24*e* extend upwardly from the lateral portions 24*a*, 24*b* so as to provide a stepped structure that elevates the central portion 24*c* relative to the lateral portions 24*a*, 24*b* and spaced the central portion 24*c* above the substrate 20 to form a cavity or gap 28 between the central portion 24*c* and the front surface 20*a* of the substrate 20. The gap 28, normally closed at the sides of the heater element 16, is substantially gas-filled and thus insulates the substrate 20 from the fluid heater element 16 in the heater substrata 22 so as to reduce heat transfer from the fluid heater element 16 to the substrate 20 and thereby enable an increased heat transfer from the fluid heater element 16 into the fluid, such as ink, in the ejection chamber 18 from each firing of the repetitive cycles of heating and ejecting of the fluid from the fluid ejection chamber 18 above the fluid heater element 16. Alternatively, the gap 28 may be provided open to allow communication of fluid flow between the ejection chamber 18 and the gap 28.

The substrate 20 is typically made from a wafer of silicon or the like. The electrically conductive layer 26 of the heater substrata 22 partially overlies the resistive layer 24. The conductor layer 26 has an anode portion 26*a* and a cathode portion 26*b* on the resistive layer 24 separated from one another by a space 30 overlying the fluid heater element 16 of the central portion 24*c* of the resistive layer 24. The anode and cathode portions 26*a*, 26*b* overlie and are deposited at least on the right and left lateral portions 24*a*, 24*b*, but also can be deposited on the right and left transitional portions 24*d*, 24*e* and spaced marginal ends of the central portion 24*c*, such that the anode and cathode portions 26*a*, 26*b* are interconnected and separated by the central portion 24*c* of the resistive layer 24. The anode and cathode portions 26*a*, 26*b* of the conductor layer 26, being positive and negative terminals of ground and power leads, cooperate with the central portion 24*c* of the resistive layer 24 to form the fluid heater element 16 of the heater substrata 22 of the first strata 12. By way of example and not of limitation, the various layers of the first strata 12 can be made of the various materials and have the ranges of thicknesses as set forth in above cited U.S. Pat. No. 7,195,343.

The second strata 14 of the heater stack 10 overlie the first strata 12 and more particularly the heater substrata 22 of the first strata 12 to protect the resistive fluid heater element 16 from the well-known adverse effects of fluid forces generated by the repetitive cycles of fluid ejection from the ejection chamber 18 above the second strata 14. Although only shown as a single layer in FIG. 1, the second strata 14 typically include at least two layers, a passivation (protective) layer and a cavitation (protective) layer. The function of the passivation layer is primarily to protect the resistive and conductor layers 24, 26 of the first strata 12 from fluid corrosion and provide electrical isolation. The function of the cavitation layer is to provide protection to the fluid heater element 16 during fluid ejection operation which would cause mechanical damage to the heater stack 10 in the absence of the cavitation layer. Any suitable material or combination of material sets that offer electrical isolation and mechanical protection of the heater substrata 22 may be used. Examples are a bi-layer stack such as made of silicon nitride and tantalum, or an ultra-thin overcoat of a protective metal oxide such as $Ta_2O_5$, $HfO_2$, $Al_2O_3$, etc. Also, by way of example and not of limitation, the various layers of the second strata 14 also can be made of the various materials and have the ranges of thicknesses as set forth in above cited U.S. Pat. No. 7,195,343.

Turning now to FIG. 2, there is illustrated a block flow diagram with accompanying schematic representations, not to scale, of a sequence of stages carried out in the making, or building the layers of, the exemplary embodiment of the heater stack 10 of FIG. 1 in accordance with the method of the present invention. As per block 32 and schematic representation (a), the substrate 20 in the first strata 12 is a base wafer or layer of silicon. All necessary logic and electrical connections have been processed and formed on the substrate 20. All the other layers of the first and second strata 12, 14 will be deposited and patterned on the substrate 20 by using selected ones of conventional thin film integrated circuit processing techniques including layer growth, chemical vapor deposition, photo resist deposition, masking, developing, etching and the like.

Next, as per block 34 and schematic representation (b), a layer 36 of sacrificial material is deposited and patterned on the front surface 20*a* of the substrate 20. The layer 36 has a predetermined size (length and width) and thickness corresponding to the desired size of the gap 28 to be provided in the heater substrata 22 of the heater stack 10. The sacrificial material layer 36 may be deposited by being spun or coated upon the front surface 20*a* of the substrate 20. Then, a photoresist mask (not shown) may be formed using conventional steps of photolithography and portions not covered by the photoresist mask are etched away leaving the layer 36 of the desired dimensions coated on the substrate 20. Alternatively, the sacrificial layer can be a photoimageable polymer, eliminating the need for the photoresist mask. However, if the polymer is non-photoimageable, then the photoresist mask will be needed. The sacrificial material 36 can be a suitable preselected polymer, a chemical vapor deposited (CVD) carbon, a diamond like carbon (DLC) deposition, a photoimageable polymer treated with a photoacid or the like. For a polymer to be suitable for use as the sacrificial material layer 36, it should be compatible with current CMOS processing conditions, i.e., its decomposition temperature should be below 450° C. However, it should also maintain its structural integrity during the heater deposition step at approximately 150° C. Under the current thermal processing conditions, preselected polymers that may be used are polyimdide, polymethylmethacrylate (PMMA), polybutylene terephthalate (PBT), polycarbonate, or polynorbornene. Different thermal processing conditions may lead to different polymer choices. The process flow is the same with use of CVD carbon instead of polymer.

Following next, as per blocks 38 and 40 and respective schematic representations (c) and (d), initially the heater substrata 22 is processed as desired. First, as per block 38, the heater or resistive layer 24, comprised of a first metal and including the lateral, central and transitional portions 24*a*-24*e*, is deposited and patterned over the sacrificial material layer 36 and the substrate 20 such that the fluid heater element 16 of the central portion 24*c* of the resistive layer 24 in the heater substrata 22 overlies the sacrificial material layer 36. Next, as per block 40, the conductor layer 26, comprised by a second metal typically selected from a wide variety of conductive metals and including the anode and cathode portions 26*a*, 26*b*, is deposited and patterned on the first metal resistive layer 24 to complete the deposition of the layers of the first strata 12. They are patterned, masked and etched, in separate steps by conventional semiconductor processes, such as wet or dry etch techniques, into the general form shown in FIG. 2. In such manner, the etched first resistive metal layer 24 provides the fluid heater element 16 of the heater stack 10 and the etched second conductor metal layer 26 provides the power (anode portion) lead 26*a* and ground (cathode portion) lead 26*b* for the resistive heater element 16. The resistive and conductor layers 24, 26 may be selected from materials and may have thicknesses such as set forth in above cited U.S. Pat. No. 7,195,343.

In the heater stack 10 of FIG. 1, it should be understood, although it is not apparent in this view, that the width of the layer 36 of sacrificial material is substantially the same as the width of the heater substrata 22. FIGS. 3 and 4 show a slight modification of the heater stack 10 in that the width of the sacrificial material layer 36 has now been made greater than the heater substrata 22 so that opposite side portions 36*a* of the sacrificial material layer 36 extend in opposite directions beyond the opposite sides of the heater substrata 22.

It is believed that the resistive layer 24 can directly cover a polymer making up the sacrificial material layer 36. However, if the resistive layer 24 is not permeable enough to the byproducts of the decomposition of the sacrificial material or the resistor's electrical properties are changed during a subsequent decomposition process, it may be advantageous to first cover the sacrificial material layer 36 with a thin overcoat 37 of a suitable dielectric material, examples of which include silicon oxide, silicon nitride, etc. as show by the dashed line in FIG. 2C. The thin overcoat 37 provides mechanical support for the resistive layer 24 as well as the option of opening or closing the gap 28 with this deposited layer. This overcoat, however, does have certain constraints. The maximum thickness is dictated by the insulative properties of the material. If the material is thicker than a few hundred Å, the thermal insulative benefit of an air gap 28 under the resistor heater element 16 could be lost.

Referring to block 42 and schematic representation (e), after the heater substrata 22 is processed, the layers making up the second strata 14 of the heater stack 10 are processed. As mentioned earlier, although shown as a single layer, these layers of the second strata 14 typically include passivation and cavitation layers. The passivation layer is deposited over and directly on the resistive and conductor layers 24, 26 of the heater substrata 22 in order to protect them from fluid (ink) corrosion. The cavitation layer is then deposited on the passivation layer overlying the heater substrata 22. The passivation and cavitation layers of the second strata 14, also referred to as the heater overcoat in U.S. Pat. No. 7,195,343, may be selected from materials and may have thicknesses such as set forth in this patent. Once the passivation and cavitation layers are deposited, they are patterned, masked and etched, in separate steps by conventional semiconductor processes, such as wet or dry etch techniques, into the general form shown in FIG. 2.

Finally, as per block 44 and schematic representation (f), once the first and second strata 12, 14 of the heater stack 10 are processed as desired, processing the sacrificial material layer 36 of the first strata 12 occurs by heating the substrate 20 to substantially remove or decompose the sacrificial material layer 36. The decomposition of the sacrificial material layer 36 results through a thermal process with or without oxygen by bringing the substrate 18 up to the thermal decomposition temperature of the sacrificial material of the layer 36. Depending on the sacrificial material composition, the decomposition process either converts the material into gaseous or minimal solid byproducts. Decomposition of the sacrificial material layer 36 may be aided with diffused oxygen from the substrate (SOG or other oxide). The decomposition products ($CO_2$ or other short carbon chain gases) diffuse into the substrate 20 or through the over layer over time, leaving the desired gas-filled cavity or gap 28 above the substrate 20 and below the heater element 16 of the heater substrata 22. It is expected that a very low percentage of residue of decomposed sacrificial material of the layer 36 is left in the cavity or gap 28.

Referring again to FIGS. 3 and 4, it is evident that opposite side portions 36*a* of the sacrificial material layer 36 extend beyond the defined area of the heater element 16. This extension allows two functional items. First, it allows the heater area to be planar by taking the air gap 28 out of the critical area. Second, the open sides of the gap 28 are normally closed off to ink by the deposited overlayer 37. The overlayer is permeable to small gaseous products (decomposed polymer gases) at elevated temperature. Additionally, it needs to be emphasized that by opening this window of sacrificial polymer around (on opposite sides of) the heater area, certain latitude is given as to when to include the polymer decomposition step in the method. The decomposition step can occur at many stages during the process and certainly after the thin film (resistive layer 24) deposition steps. Also, the presence of the gap 28 and its normally closed sides below the heater element 16 means that the gap 28 will fill with the insulative gas. Alternatively, if desired the gap 28 may be provided open to allow communication of fluid flow between the ejection chamber 18 and the gap 28.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A heater stack for a micro-fluid ejection device, comprising:

first strata configured to support and form a fluid heater element responsive to energy from repetitive electrical activation and deactivation to fire repetitive cycles of heating and ejecting of a fluid from an ejection chamber above said fluid heater element, said first strata including a substrate and a heater substrata overlying said substrate;

said heater substrata including a resistive layer having lateral portions spaced apart from each other, a central portion extending generally between said lateral portions and defining said fluid heater element of said first strata, and transitional portions respectively interconnecting said central portion and lateral portions and extending upwardly from said lateral portions so as to elevate said central portion relative to said lateral portions and space said central portion above said substrate to form a gap extending between said lateral portions and between said central portion and said substrate substantially insulating said substrate from said fluid heater element so as to reduce heat transfer from said fluid heater element to said substrate and thereby increase heat transfer into the fluid in said ejection chamber from firing said repetitive cycles of heating and ejecting of the fluid from the ejection chamber above said fluid heater element, wherein said heater substrata also includes a conductive layer having an anode portion and a cathode portion on said resistive layer separated from one another by a space overlying said fluid heater element of said central portion of said resistive layer, said anode and cathode portions overlying and deposited on at least said lateral portions of said resistive layer such that said anode and cathode portions are interconnected and separated by said central portion of said resistive layer to define said fluid heater element therewith.

2. The heater stack of claim 1 wherein said gap along opposite sides of said central portion of said resistive layer of said heater substrata is open through a layer underlying said resistive layer providing mechanical support of said resistive layer.

3. The heater stack of claim 1 wherein said gap along opposite sides of said central portion of said resistive layer of said heater substrata is closed by a layer underlying said resistive layer providing mechanical support of said resistive layer.

4. The heater stack of claim 1 further comprising:

second strata overlying said heater substrata of said first strata and contiguous with said ejection chamber to provide protection of said fluid heater element from adverse effects of said repetitive cycles of heating and ejecting fluid from the ejection chamber and of contact with the fluid in said ejection chamber.

5. The heater stack of claim 4 wherein said second strata includes a protective layer overlying said anode and cathode portions of said conductor layer and also overlying said central portion of said resistive layer defining said fluid heater element of said heater substrata.

6. The heater stack of claim 1 further comprising:

second strata overlying said heater substrata of said first strata and contiguous with said ejection chamber to provide protection of said fluid heater element from adverse effects of said repetitive cycles of heating and ejecting fluid from the ejection chamber and of contact with the fluid in said ejection chamber.

7. The heater stack of claim 6 wherein said gap along opposite sides of said central portion of said resistive layer of said heater substrata is open through a layer underlying said resistive layer providing mechanical support of said resistive layer.

8. The heater stack of claim 1 wherein said heater substrata further includes a protective layer between said substrate and resistive layer so as to overlie said gap and protect an underside of said fluid heater element from prolonged contact with the fluid in said gap when said gap is provided open through said protective layer.

9. The heater stack of claim 6, wherein said gap along opposite sides of said central portion of said resistive layer of said heater substrata is closed by a layer underlying said resistive layer providing mechanical support of said resistive layer.

* * * * *